United States Patent [19]

Riggs, Jr. et al.

[11] 4,222,826

[45] Sep. 16, 1980

[54] PROCESS FOR OXIDIZING VANADIUM AND/OR URANIUM

[75] Inventors: Olen L. Riggs, Jr., Bethany; Dennis A. Brunsell, Oklahoma City, both of Okla.

[73] Assignee: Kerr-McGee Corporation, Oklahoma City, Okla.

[21] Appl. No.: 949,885

[22] Filed: Oct. 10, 1978

[51] Int. Cl.[2] ..... C25C 1/22

[52] U.S. Cl. ..... 204/1.5; 204/1 R; 204/130

[58] Field of Search ..... 204/1 R, 1.5, 130

[56] References Cited

U.S. PATENT DOCUMENTS 4,116,783 9/1978 Generini ..... 204/130

FOREIGN PATENT DOCUMENTS 535221 11/1976 U.S.S.R. ..... 204/1.5

*Primary Examiner*—Leland A. Sebastian

*Attorney, Agent, or Firm*—William G. Addison

[57] ABSTRACT

The present invention provides a process for rapidly and efficiently oxidizing either or both vanadium and uranium from the trivalent and guadrivalent oxidation states, respectively, to the pentavelent and hexavalent oxidation states, respectively, through the use of a special electrode. The electrode is produced by anodically treating a substrate material selected from the group of titanium, zirconium, niobium, hafnium and alloys thereof in an aqueous electrolyte. The electrolyte comprises an aqueous solution of manganous ion in a concentration of from about 15 to 50 gm/l and from about 10 to 40 gm/l sulfuric acid. Manganese dioxide is electrodeposited on the substrate to form the electrode. The manganese dioxide coated electrode then is placed in an oxidation cell as an anode wherein it is potentiostaticly controlled to oxidize either or both vanadium and uranium without significant anode deterioration and without oxygen generation at the anode.

10 Claims, No Drawings

PROCESS FOR OXIDIZING VANADIUM AND/OR URANIUM

BACKGROUND OF THE INVENTION

1. Field of the Invention

This invention relates to an electrode and a process for the use thereof as an anode to oxidize either or both vanadium and uranium without deterioration of the anode and without oxygen generation at the anode.

2. Description of the Prior Art

Wet process phosphoric acid has been found to be a valuable source of vanadium and uranium. Numerous solvent extraction techniques have been developed to separate and recover the vanadium and uranium from the wet process phosphoric acid. The solvents employed in these various techniques normally are highly selective organic extractants which exhibit a particular affinity for either or both vanadium and uranium specie in a particular valence state. Vanadium and uranium normally are present in wet process phosphoric acid in the trivalent and quadrivalent oxidation states, respectively. In most processes, it is necessary to oxidize the vanadium and uranium to higher valence states to obtain effective solvent extraction. In many processes, the oxidation is effected through the addition of certain oxidants such as, for example, sodium chlorate, manganese dioxide, ozone and the like. The oxidant is added in an amount sufficient to provide at least the stoichiometric amount required for oxidation of all the vanadium and uranium. When the uranium and vanadium-free wet process phosphoric acid is to be used for animal feed supplements and the like, it is undesirable to add chemicals such as oxidants to the wet process phosphoric acid which will constitute a contaminant of the final end product.

Electrochemical oxidation of the vanadium and uranium can be effected through constant applied current and constant applied voltage techniques. A control system employing constant applied current maintains the current density constant regardless of the resistence changes in the load on the system. A control system employing constant applied voltage maintains the cell voltage of the system at a constant pre-determined voltage regardless of the percentage of load on the system.

All electrochemical reactions proceed to a specific end product by means of an electrical potential. The more closely this potential is maintained, the more efficient is the reaction. If the critical potential of an electrochemical reaction is maintained correctly, the current density and cell voltage can vary autonomously over a substantial range without adversely effecting the reaction.

SUMMARY OF THE INVENTION

The discovery now has been made that the electrode and process of the present invention provide a means of rapidly and efficiently oxidizing vanadium and uranium to the pentavalent and hexavalent oxidation states, respectively.

The electrode is produced by anodically treating a substrate material selected from the group of titanium, zirconium, niobium, hafnium and alloys thereof in an aqueous electrolyte comprising an aqueous solution of manganous ion in a concentration of from about 15 to 50 gm/l and from about 10 to 40 gm/l sulfuric acid. Manganese dioxide is electrodeposited to form the electrode under controlled potential techniques.

Alternatively, the manganese dioxide may be electrodeposited upon the substrate material by constant current techniques wherein the substrate material is subjected to electrodeposition at a constant current density.

The manganese dioxide coated electrode then is placed as an anode in an electrolytic cell containing either or both vanadium and uranium for oxidation under controlled potential techniques. A reference electrode is provided and the potential between the anode and the reference electrode is controlled by, for example, a potentiostat to be in the range of from about +1200 millivolts to about +1800 millivolts. The controlled potential technique permits the oxidation reaction to be controlled at the most efficient electrical potential for the reaction. This results in a current efficiency in the range of from about 93 to about 99 percent. Further, the oxidation reaction is effected without evolution of oxygen at the anode surface and without substantial deterioration of the anode.

DESCRIPTION OF THE PREFERRED EMBODIMENT

In accordance with one embodiment of the present invention an electrode is prepared by first sandblasting or otherwise cleaning a substrate material to remove contaminants and any undesirable oxides from the surface thereof.

The substrate may be titanium. The term "titanium" as used herein includes not only titanium but its alloys such as for example, Ti-13V-11Cr-Al, Ti-6Al-6V-2Sn and Ti-8Al-1Mo-1V. Also contemplated herein as metals selected from the group consisting of tantalum, zirconium, niobium, hafnium and their alloys. The titanium may be in any form such as, for example, bar, plate, flat sheet, sheets of expanded metal and the like.

The cleaned substrate then is placed in an electrolytic cell for the electrodeposition of manganese dioxide. That treatment cell contains an electrolyte comprising an aqueous solution containing manganous ion in a concentration of from about 15 to about 50 grams per liter and from about 10 to about 40 grams per liter sulfuric acid. The electrodeposition temperature is not critical, however, the current efficiency of the treatment cell improves at elevated temperatures. Therefore, the electrolyte temperature preferably is maintained within a range of from about 80 degrees C. to about 98 degrees C. The cathode material is not critical and suitable materials include copper, nickel, mild steel, stainless steel, graphite, platinum and the like.

The manganese dioxide electrodeposition cell is connected by suitable means to a reference cell. The reference cell may comprise, for example, a standard calomel electrode cell or any other reference electrode.

The electrodeposition of the manganese dioxide on the substrate material is controlled by maintaining a preselected control potential between the substrate material and the reference cell. The preselected control potential is a function of the particular reference electrode cell employed in the electrodeposition. The control potential selected when a standard calomel electrode reference cell is employed is in the range of from about +1400 millivolts to about +1600 millivolts versus a standard calomel electrode (hereafter SCE).

The treatment time is not critical and normally need be no longer than the time required to at least partially coat the surface of the substrate material with electrodeposited manganese dioxide.

In accordance with an alternate embodiment of the present invention the substrate material may be made the anode in an electrolytic cell having a suitable cathode in order to pretreat the substrate to improve the quality of manganese dioxide subsequently electrodeposited thereon. The cathode material is not critical and suitable materials include copper, nickel, mild steel, stainless steel, graphite, platinum and the like.

The pretreatment cell contains an electrolyte comprising an aqueous solution of fluoride ions and at least one compound selected from the group consisting of ethylene glycol, acetic acid and a mixture of phosphoric acid and nitric acid.

The pretreatment cell is connected by a suitable salt bridge, if necessary, to a reference cell. The reference cell may comprise, for example, a standard calomel electrode cell in which case the salt bridge preferably is agar-agar saturated with potassium chloride.

The composition of the pretreatment cell electrolyte is critical. The concentration of fluoride ion in the electrolyte must be at least about 25 grams per liter of electrolyte. Generally, it is desirable that the fluoride ion concentration be maintained within a range of from about 55 to about 75 grams per liter. Particularly good results have been obtained with a fluoride concentration of about 70 grams per liter.

The source of fluoride ion is not critical. The fluoride may be introduced into the electrolyte in the form of an aqueous solution of hydrofluoric acid, by bubbling fluorine gas through the electrolyte and the like. Other sources of fluoride ion include sodium fluoride, potassium fluoride, magnesium fluoride, zinc fluoride, trifluoroacetic acid and other inorganic and organic fluoride compounds. Generally, it is preferred to use an aqueous solution of hydrofluoric acid as the source of fluoride ion.

Further, the pretreatment cell electrolyte also must contain at least one other compound, either acetic acid, ethylene glycol or a mixture of phosphoric and nitric acid. Such other compound should be present in an amount within the range of from about 700 to about 1300 grams per liter of electrolyte and preferably within the range of from about 800 to about 1200 grams per liter. The optimum concentration will depend, among other things, on the particular compound selected. When using ethylene glycol or acetic acid, it generally is preferred to maintain a concentration of from about 850 to about 1000 grams per liter.

When using a mixture of phosphoric and nitric acid, however, it is advantageous to maintain the concentration within the range of from about 800 to about 1200 grams per liter and preferably within the range of from about 900 to about 1100 grams per liter. Further, when the other compound is a mixture of phosphoric and nitric acid, the weight ratio of phosphoric to nitric acid should be within the range of 5:1 to 2:3 and preferably within the range of from 3:1 to 3:2.

The actual part played by the fluoride and the other compound in this pretreating method is not fully understood and the inventors do not wish to be bound by a particular theory.

The substrate material, after being placed in the pretreatment electrolyte is anodically pretreated at an anodic current density sufficient to maintain a preselected control potential between the substrate material and the reference cell. The reference electrode in the reference cell senses the electrochemical potential of the substrate material and through a control circuit such as, for example, a potentiostat, causes the electrical current and voltage to vary as required to maintain the preselected potential value. A preferred form of a control circuit for commercial use is disclosed in U.S. patent application Ser. No. 885,397 filed Mar. 10, 1978. The preselected control potential is a function of the particular reference electrode cell employed in the treating method. The control potential valve may be adjusted to compensate for the differences between various other reference electrodes and the reference potential of a SCE. The magnitude of the adjustment is in the order of the difference between the other electrode's reference potential and the reference potential of a SCE. The control potential selected when a standard calomel electrode reference cell is employed is in the range of from about 7 volts to about 9 volts. Preferably, the control potential is in the range of from about 7.9 volts to about 8.1 volts versus a SCE.

The pretreatment time generally is within the range of from about 2 minutes to about 30 minutes. During the pretreatment an adherent gray film forms on the surface of the substrate material. The film is substantially uniform across the surface of the substrate material.

Temperature does not appear to be a critical parameter in the pretreatment method of the present invention. In fact, within a temperature range of from about 20 degrees C. to about 50 degrees C. substantially no difference in the efficacy of the invention is observed.

After the substrate material has been pretreated in accordance with the present method, it then is removed from the electrolytic cell and preferably washed with water prior to insertion into the manganese dioxide electrodeposition cell for treatment therein.

When the substrate material has been pretreated in accordance with the method of the instant invention it is possible to operate the manganese dioxide electrodeposition cell through constant current techniques at an anodic current density of from about 8 to about 30 amps/ft$^2$ or even higher to produce the manganese dioxide coating. Generally, in such a circumstance, it is preferred to maintain the anodic current density within the range of from about 12 to about 20 amps/ft$^2$.

When the substrate material has not been pretreated as previously set forth, manganese dioxide nonetheless may be electrodeposited thereon through use of the controlled potential electrodeposition technique previously described. However, in the event the non-pretreated substrate material is to have manganese dioxide electrodeposited thereon by constant current techniques, the anodic current density applied to the substrate material must be lower than the current density which may be applied to pretreated substrate material to avoid passivation. Generally, the anodic current density is maintained in a range of from about 5 to about 10 amps/ft$^2$ to avoid passivation of the substrate material.

The manganese dioxide coated electrode produced by any of the previously described means then is made the anode of an electrolytic cell for the oxidation of either or both vanadium and uranium. The electrolytic cell also contains a cathode which may comprise, materials, such as, for example, titanium, mild steel, stainless steel, platinum, graphite and the like. Preferably, the cathode comprises a material which will not contaminate the electrolyte through degradation.

The oxidation cell contains an electrolyte comprising an aqueous solution containing either or both vanadium and uranium specie. Preferably, the electrolyte comprises wet process phosphoric acid.

The oxidation cell is connected by suitable means to a reference cell. The reference cell may comprise, for example, a standard calomel electrode cell, a silver/silver chloride electrode or any other reference electrode. The oxidation of the vanadium and uranium in the electrolyte is controlled through maintaining a preselected control potential between the manganese dioxide coated anode and the reference cell. The control potential selected when a silver/silver chloride reference electrode is employed is in the range of from about +1200 millivolts to about +1800 millivolts versus the reference electrode. Preferably, the control potential is in the range of from about +1400 millivolts to about +1600 millivolts.

The treatment time is a function of the concentration of the vanadium and uranium present in the electrolyte that is to be oxidized to a higher valence state.

While the effect of temperature has not been specifically evaluated, oxidation of the electrolyte has been successfully accomplished by the process of the present invention within a temperature range of from about 45 degrees C. to about 55 degrees C.

It should be noted that no other additional semiconductive materials or other inorganic materials commonly referred to as "dopents" are required to produce the treated anode of the present invention and that said treated anode exhibits current efficiencies in excess of 99 percent. Further, the anode does not appear to deteriorate during usage. In fact, under certain conditions, the anode has been found to actually regenerate during the electrolytic oxidation process. In the event sufficient manganous ion is present in the oxidation cell electrolyte, the manganous ion deposits upon the substrate material as manganese dioxide while either or both the vanadium and uranium specie are oxidized.

The following example is provided for the purpose of illustrating the efficacy of the present invention and is not to be construed as limiting the scope thereof.

EXAMPLE

An electrode is prepared by anodically treating a coupon of expanded sheet titanium having a surface area of 8 square inches under controlled potential techniques in an electrolytic cell containing an electrolyte comprising 50 gm/l manganous ion and 30 gm/l sulfuric acid. The electrolyte is maintained at a temperature of about 90 degrees C. The reference electrode is a silver/silver chloride electrode and the cathode is titanium. The anodic treatment is effected at a controlled reference potential of +1600 millivolts versus the reference electrode and is of 10 minutes duration. The treatment results in the formation of a uniform manganese dioxide coating upon the surface of the titanium coupon.

The manganese dioxide coated titanium coupon is placed in another electrolytic cell containing 220 ml of an electrolyte comprising wet process phosphoric acid containing 16.7 milliequivalents per liter of oxidizable vanadium specie, as the anode. The cathode is platinum and the reference electrode is a silver/silver choride electrode. The temperature of the electrolyte is maintained at about 50 degrees C. The electrolytic cell is operated under controlled potential techniques to oxidize the vanadium present in the wet process acid to the pentavalent oxidation state. The control potential is maintained at +1500 millivolts versus the reference electrode.

A 2 ml sample of the electrolyte is withdrawn at 10 minute intervals and subjected to titrametric analysis employing conventional analytical techniques to determine the quantity of vanadium specie not oxidized to the pentavalent state. The results of the titrametric analyses are set forth in Table I below.

TABLE I

| Sample No. | Time Minutes | Current Amps | Milliequivalents/Liter $V^{+4}$ by Titrametric Analysis |
|---|---|---|---|
| 1 | 0 | 0.089 | 16.7 |
| 2 | 10 | 0.083 | 14.7 |
| 3 | 20 | * | * |
| 4 | 30 | 0.071 | 11.3 |
| 5 | 40 | 0.068 | 7.2 |
| 6 | 50 | 0.060 | 5.9 |
| 7 | 60 | 0.061 | 4.1 |
| 8 | 70 | * | 3.6 |
| 9 | 80 | 0.057 | 2.2 |
| 10 | 90 | 0.060 | 0.5 |
| 11 | 100 | 0.058 | 0.0 |

*No data recorded

The current efficiency is determined by graphical integration and is found to exceed 98 percent. The rate of vanadium oxidation to the pentavalent oxidation state is determined by graphical integration and is about 0.9 milliequivalents/$ft^2$/min.

The manganese dioxide coated titanium coupon is removed from the electrolytic cell and a platinized titanium electrode (Engelhard Series 1100, produced by Engelhard Minerals and Chemicals Corporation, East Newark, New Jersey) of substantially the same surface area is inserted into the cell. The electrolyte is replaced with 220 ml of fresh electrolyte containing 16.7 milliequivalents per liter of oxidizable vanadium. The electrolytic cell is operated as previously described. The rate of vanadium oxidation to the pentavalent oxidation state is determined by graphical integration and is less than one third the rate of the treated anode of the present invention. The preceeding results demonstrate the efficacy of the treated anode and process of the present invention.

While the present invention has been described with respect to what at present are considered to be the preferred embodiments thereof, it is to be understood that changes or modifications in the apparatus or procedure of this invention can be made without departing from the spirit or scope of the invention as defined by the following claims.

What is claimed is:

1. An electrolytic oxidation process comprising:

providing an electrolytic cell containing an anode comprising a substrate material selected from the group of titanium, tantalum, zirconium, niobium, hafnium and alloys thereof upon which manganese dioxide has been electrodeposited and a cathode;

providing said electrolytic cell with an electrolyte containing oxidizable specie selected from the group of vanadium and uranium;

providing a reference electrode in ionic contact with the electrolyte; and electrolyzing the electrolyte within the electrolytic cell by potentiostatic means wherein the electrical potential between the anode and the reference electrode is maintained in a preselected range to oxidize those specie present in the electrolyte capable of oxidation thereby.

2. The process of claim 1 wherein the electrical potential between the anode and reference electrode is maintained in the range of from about +1200 to about +1800 millivolts.

3. The process of claim 1 wherein the electrical potential between the anode and reference electrode preferably is maintained in the range of from about +1400 to about +1600 millivolts.

4. The process of claim 1 wherein the electrolyte is electrolytically oxidized without the evolution of oxygen at the anode.

5. The process of claim 1 defined further to include the step of:

maintaining the electrolyte at a temperature of from about 45° to about 55° degrees C.

6. The process of claim 1 wherein the electrolyte comprises wet process phosphoric acid.

7. The process of claim 1 wherein the substrate material is pretreated prior to electrodeposition of manganese dioxide thereon.

8. The process of claim 7 wherein the pretreatment is defined further as:

providing an aqueous electrolyte containing at least 25 gm/l fluoride ions and from about 800 to 1200 gm/l of at least one other compound selected from the group consisting of acetic acid, ethylene glycol and a mixture of nitric acid and phosphoric acid;

providing a reference cell positioned in such manner as to be in ionic contact with the aqueous electrolyte;

placing the substrate material to be pretreated in contact with said aqueous electrolyte and placing a cathode in contact with said aqueous electrolyte; and electrolyzing said aqueous electrolyte at sufficient anodic current density to maintain a control potential measured between the anode and the reference cell in the range of from about 7.0 to 9.0 volts.

9. The process of claim 8 wherein said electrolyzing of the aqueous electrolyte is effected for a sufficient amount of time to cause the formation of a gray film upon the surface of the substrate material in contact with the aqueous electrolyte.

10. The process of claim 1 wherein the substrate material comprises titanium.

* * * * *